United States Patent [19]

Fray

[11] Patent Number: 4,999,092

[45] Date of Patent: Mar. 12, 1991

[54] TRANSPORTING A LIQUID PAST A BARRIER

[75] Inventor: Derek J. Fray, Cambridge, England

[73] Assignee: Metallurg, Inc., New York, N.Y.

[21] Appl. No.: 325,441

[22] Filed: Mar. 20, 1989

[30] Foreign Application Priority Data

Mar. 29, 1988 [GB] United Kingdom ..... 8807411

[51] Int. Cl.[5] ..... C25C 3/04; C25C 3/02; C25C 3/24

[52] U.S. Cl. ..... 204/68; 204/70; 204/237; 204/245; 210/738; 210/801

[58] Field of Search ..... 204/67, 68, 70, 245, 204/1 R, 237; 210/767, 776, 800, 803, 804, 805, 416.1, 513, 521-522, 532.1, 533-538, 540, 542, 748, 801

[56] References Cited

U.S. PATENT DOCUMENTS

| | | | |
|---|---|---|---|
| 2,204,180 | 6/1990 | Gerlach | 156/623 R |
| 2,861,030 | 11/1958 | Slatin | 204/64 |
| 2,919,234 | 12/1959 | Slatin | 204/67 |
| 3,335,076 | 8/1967 | Burkhardt | 204/67 X |
| 3,620,942 | 11/1971 | Day | 204/245 X |
| 3,674,567 | 7/1972 | Bradley et al. | 204/68 X |
| 4,076,602 | 2/1978 | Wheeler | 204/237 X |
| 4,411,747 | 10/1983 | Dawless et al. | 204/67 |
| 4,681,671 | 7/1987 | Duruz | 204/67 |
| 4,740,279 | 4/1988 | Müller et al. | 204/245 X |
| 4,744,876 | 5/1988 | Bernard et al. | 204/245 |

*Primary Examiner*—Donald R. Valentine
*Attorney, Agent, or Firm*—L. S. Van Landingham, Jr.

[57] ABSTRACT

The invention provides a method of transporting a liquid A past or around a barrier, by adding a solute S to liquid A on one side of the barrier and correspondingly removing solute S from liquid A on the other side of the barrier, the solute S being such as to change the density of the liquid A when dissolving in it, thereby providing a motive force for its motion around the barrier. An example of the application of the invention is in a two-part electrolytic cell (1) comprising electrowinning and electrofining half cells (2 and 3, respectively), wherein the metal, solute S, is electrowon into a liquid (16,16*a*), liquid A, on one side of the cell's common electrode (4), the barrier, in the electrowinning half cell (2), and electrolytically removed from the liquid (17,17*a*) on the other side of the common electrode (4), in the electrorefining half cell (3).

20 Claims, 1 Drawing Sheet

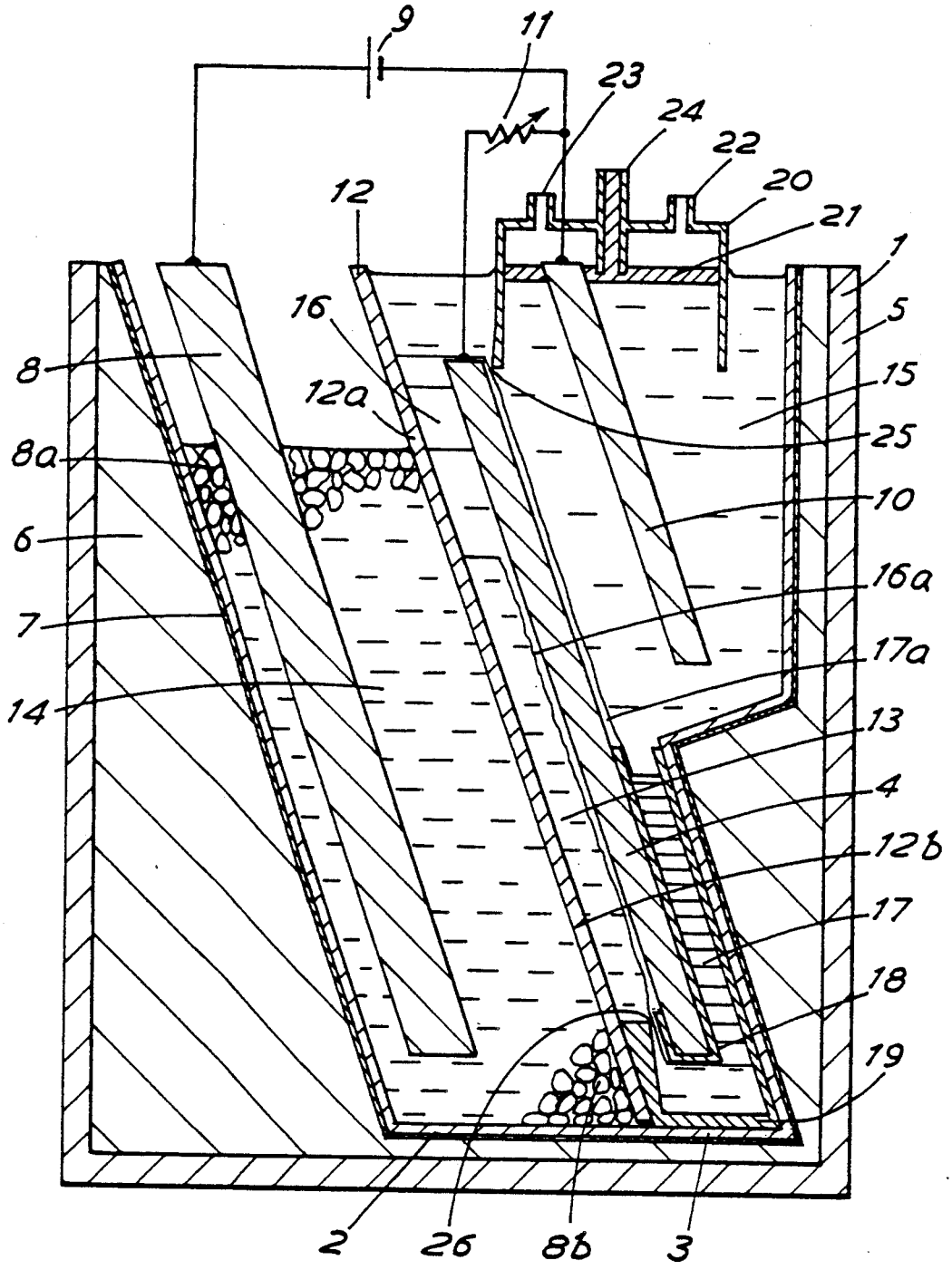
9
11
23
24
22
20
21
12
1
5
16
8
15
12a
25
8a
10
6
16a
7
17a
14
13
4
12b
17
18
19
2
26
8b
3

TRANSPORTING A LIQUID PAST A BARRIER

This invention relates to a method of transporting a liquid past a barrier, which method does not require the use of a pump.

There are many situations where it would be advantageous to be able to avoid a need for a pump when transporting a liquid past a barrier. The problem is particularly troublesome where the liquid is deleterious towards the materials from which pumps are generally made, as is usually the case with most molten metals.

The need to transport a molten metal past a barrier arises quite often in the field of electrolysis, for example where a metal melt is to be transported from one side of an electrode to an opposite side of the electrode. A particular example where that need can arise is in an electrolytic cell for electrowinning and then electrorefining a metal.

In one form of such a cell, the cell comprises an electrowinning half cell and an electrorefining half cell, the two half cells sharing a common electrode, which is sometimes referred to as the bipolar electrode. In the electrowinning half cell, the metal which is to be produced is electrolytically deposited, in impure form, at the common electrode, which acts as the cathode for the electrowinning half cell. In the electrorefining half cell, the common electrode acts as an anode, and the electrowon metal at the common electrode is purified electrolytically, to be deposited in purified form at the cathode of the electrorefining half cell.

The arrangement normally employed at the common electrode in such electrowinning-electrorefining two-part cell arrangements is such that the metal which is being produced is electrodeposited in the electrowinning half cell into a solvent or alloying metal melt which serves as, or is electrically in contact with, the common electrode. The metal is then electrolysed out of the alloying metal in the electrorefining half cell, to be electrodeposited at the anode of the electrorefining half cell. The cell includes a barrier to prevent the electrolyte in the electrowinning half cell from coming into contact with the electrolyte in the electrorefining half cell.

U.S. Pat. Nos. 2,861,030 and 2,919,234 describe examples of a certain type of combined electrowinning-electrorefining two-part cell of the kind described above, known as the Slatin cell, after its inventor. The Slatin cell comprises a container having a generally horizontal floor which supports a submerged molten metal common electrode extending over both of the half cells. A depending baffle which dips into the common electrode serves to separate the electrolytes in the two half cells from each other. The anode of the elctrowinning half cell and the cathode of the electrorefining half cell dip into their respective electrolytes, both of which float on top of the common molten metal electrode.

For example, in the two-part cell of that type described in U.S. Pat. No. 2,861,030, the common electrode is molten copper, the electrolyte in the electrowinning half cell comprises titanium oxide in a molten chloride salt mixture, and a molten chloride salt mixture is used as the electrolyte in the electrorefining half cell. In the electrowinning half cell, titanium ions are discharged at the common electrode, and the resulting titanium metal plus impurities dissolves in the copper melt. In the electrorefining half cell, the titanium is then re-ionised and passes through the electrolyte, to be deposited, in purified form, at the cathode of the electrorefining half cell.

So far as we are aware, the Slatin cell has never achieved commercial success. We believe that a significant reason for its lack of adoption is the problems which are associated with the need to transport the metal in the common electrode alloy from the electrowinning half cell, past the depending barrier, to the electrorefining half cell. In theory, one could rely entirely on diffusion of the dissolved metal (titanium in the example mentioned above) through the common electrode metal (copper in the above example). In practice, the rate of diffusion would be insufficient to provide an economically viable rate of metal production. With the Slatin cell, one would then be led to employ some kind of pump, to move the titanium-bearing copper (in the example described above) to the refining half cell, with all of the obvious difficulties that that would entail.

In addition, the configuration of the electrodes employed in the Slatin cell gives rise to the following disadvantages:

(a) the cell occupies a large floor area;

(b) the distance between the anode in the electrowinning half cell and the common electrode has to be made large to prevent back reaction, which leads to large electrolyte resistance losses; and (c) the current paths within the cell will generally be irregular, because of mis-matches between the surface areas of the electrodes, both in the electrowinning half cell and in the electrorefining half cell.

According to the present invention, there is provided a method of transporting a liquid A past a barrier, the method comprising: providing liquid A on both a first and a second side of the barrier, the liquid A on the first side being in hydrostatic communication with that on the second side both over and under the barrier, and liquid A on at least the second side of the barier containing a solute S, solute S being such that increasing the concentration of solute S in liquid A either (a) increases or (b) decreases the density of the solution; and introducing solute S into liquid A on the first side of the barrier and removing solute S from liquid A on the second side of the barrier, whereby to cause passage of liquid A around the barrier, with S-rich liquid A from the second side passing over the barrier in case (a), and S-rich liquid A from the first side passing over the barrier and S-depleted liquid A from the second side passing under the barrier in case (b).

If one continues to introduce solute S into liquid A on the first side of the barrier after S-depleted liquid A reaches the first side from the second side, and to remove solute S from liquid A on the second side of the barrier after S-rich liquid A reaches the second side from the first side, then there will be circulation of liquid A around the barrier.

It will be appreciated that, in the method of the present invention, when solute S is added to and removed from liquid A on the respective two sides of the barrier, the resulting changes in densities of liquid A provide a motive force for transporting the liquid A past or, as the case may be, around the barier, without a need for a pump.

We expect that the main application of the invention will be in cases where the liquid A is a metal, because of the difficulties which arise in transporting metals using pumps.

In the commercially significant applications of the invention which we envisage, the solute S will normally be a metal. We also envisage that the invention will find commercial application in embodiments in which: the solute S is introduced into liquid A on the first side of the barrier electrolytically; and/or the solute S is removed from liquid A on the second side of the barrier electrolytically. However, it will be appreciated by those skilled in the art that non-electrolytic means may be used to introduce and/or to remove the solute S.

In a preferred method of practising the invention, a liquid of low density LD hydrostatically connects the upper surface of a body of liquid A which extends downwardly from the top of the barrier on one side of the barrier with the upper surface of a body of liquid A which extends upwardly from the bottom of the barrier on the other side of the barrier, and a liquid of relatively high density HD hydrostatically connects the respective lower surfaces of those two bodies of liquid A. That preferred method has the advantage that when the liquid A of relatively high density at the bottom of the barrier passes under the barrier, it then rises up through the liquid LD to the liquid A which extends downwards from the top of the barrier in a spread-out stream, thus presenting a relatively high surface area for addition (in case (a)) or removal (in case (b)) of solute S.

Conveniently there is a constriction at the top and/or bottom of the barrier, to control the rate of transport of liquid A.

In the main application of the invention which we envisage, the method is performed in the course of the electrolytic production of a metal M in an electrolytic cell which comprises an electrowinning half cell and an electrorefining half cell, the barrier separating the two half cells, and during operation of the cell the liquid A dissolving metal, acting as solute S, produced in the electrowinning half cell, and being transported past the barrier to the electrorefining half cell, where dissolved metal is removed from the liquid A and electrorefined. In accordance with that application, it is possible to solve the problems discussed above which arise in connection with the use of Slatin cells.

In a preferred arrangement, the barrier is electronically conductive and acts as a common electrode for the electrowinning and electrorefining half cells.

We also prefer that the liquid A be electronically conductive and electrically in contact with the common electrode for the electrowinning and electrorefining half cells.

Preferably, the liquid A is electronically conductive and is electrically in contact with the barrier, and the barrier is also electronically conductive and acts as a common electrode for the two half cells. In such an arrangement, ions of the metal M lose their charge at the liquid A in the electrowinning half cell and dissolve in liquid A, acting as solute S, and in the electrorefining half cell, the metal leaves the liquid A giving up electrons and becoming ionised again, and the ions of the metal lose their charge at the cathode of the electrorefining cell, where the metal is deposited in purified form.

In the latter arrangement, the liquid A preferably wets the common electrode barrier: we have found that this aids the passage of electric charge between the common electrode barrier and the liquid A on both sides of the barrier, and thus aids the discharge of the metal ions at the common electrode in the electrowinning half cell as well as reionisation of the metal at the common electrode in the electrorefining half cell. We also prefer that, in such an arrangement, the common electrode barrier is inclined such that it overhangs liquid A passing under it and projects under liquid A passing over it: it will be appreciated that this will help to ensure good electrical contact between the liquid A and the common electrode both when the metal M is being electrolytically introduced into the liquid A and when it is being electrolytically removed from the liquid A.

Where, as is preferred, the barrier is electronically conductive, the material for the barrier can be selected from all suitable solid electronic conductive materials, and candidates are metals (e.g. iron and steel), carbon, refractory hardmetals (e.g. titanium diboride), electronically conducting metal oxides, and composites, for example a composite of carbon and a refractory hardmetal such as titanium diboride. In selecting the electronically conductive material, regard should be had to the properties it will have under the conditions of use, especially its ability to resist attack by other materials with which it will come into contact in use.

In the application of the invention involving electrowinning and electrorefining metals, the liquid A should be selected so that it is capable not only of performing its main function of acting as a solvent for the metal which is to be electrowon and electrorefined: regard should also be had to its ability to eliminate impurities from the metal being produced. There are two ways in which liquid A can help eliminate a given impurity. Firstly, it can have a limited or no ability to take up the impurity (by dissolving it for example). Secondly, it can have a restricted ability to give up any impurity it may have taken up to the electrolyte in the electrorefining half cell.

We have used the main, electrolytic, application of the invention for the electrowinning and electrorefining of lithium metal. For that application, we have found that a suitable liquid A comprises aluminium, preferably aluminium which is commercially pure (ignoring the lithium which is alloyed with it during operation, and also impurities geting into it from the electrowinning half cell during operation). We have also found that a suitable barrier for use in that embodiment (and indeed in any embodoment in which the liquid A is based on aluminum) is one which comprises a hardmetal, preferably titanium diboride, because it is electronically conductive, is wet by, and is resistant to, aluminium melts. Such a barrier could substantially consist of the hardmetal, or comprise a composite of carbon and the hardmetal. We especially prefer that the electrolyte in the electrowinning half cell in that embodiment comprises lithium carbonate, the anode reaction in that half cell being:

$$2CO_3^{=} + C = 3CO_2 + 4e.$$

In the application described above for the electrowinning and electrorefining of lithium, an alternative liquid A is one comprising magnesium. In that case iron or steel could be considered for use as an electronically conductive material for the barrier.

The main, electrolytic, application of the invention may be applied for the electrowinning and electrorefining of other metals, magnesium for example. A preferred liquid A for use with magnesium comprises aluminium, preferably aluminium which is commercially pure (ignoring the magnesium which is alloyed with it during operation and also the impurities which get in during cell operation). The preferred raw material for introduction at the anode of the electrowinning half cell for the production of magnesium is magnesium oxide.

In order that the invention may be more fully understood, an embodiment in accordance therewith will now be described with reference to the single figure of accompanying schematic drawing, which shows, partially in section, an electrolytic cell for electrowinning and electrorefining lithium by a method in accordance with the invention.

BRIEF DESCRIPTION OF THE DRAWING

The drawing shows an electrolytic cell 1 for the production of lithium metal, the electrolytic cell comprising an electrowinning half cell 2 and an electrorefining half cell 3, the half cells 2 and 3 being separated by a barrier 4.

Cell 1, which is shown as viewed from the front, is built within a stainless steel casing 5, which is surrounded by a layer of A P Green alumina castable refractory (not shown). The internal shape of cell 1 is provided by graphite blocks, as shown at 6, the blocks being cemented together by Sauereisen alumina cement. Fired alumina tiles 7 line the internal void defined by the blocks 6.

The barrier 4 is electronically conductive, being in the form of a titanium diboride plate running from the front to the back of the cell, and acts as a common electrode for the half cells 2 and 3.

In the electrowinning half cell 2, the barrier electrode 4 acts as the cathode, and the half cell 2 includes a carbon anode 8, which in turn is electrically in contact with a packed bed of carbon granules, shown in part only at 8*a* and 8*b*. The packed bed greatly increases the effective surface area of the anode, and thus enables a relatively high current, while avoiding an excessive effective current density.

In the electrorefining half cell 3, the barrier electrode 4 acts as the anode, and the half cell includes a steel cathode 10. Cathode 10 and barrier electrode 4 are connected to a variable voltage d.c. electrical supply 11.

A variable voltage d.c. electrical supply 9 is connected across the anode 8 of the electrowinning half cell and the cathode 10 of the electrorefining half cell. A variable resistance 11 is connected between the barrier electrode 4 and the cathode 10, to allow a slight current leakage between those two electrodes, to compensate for the generally lower current efficiencies in the electrowinning half cell compared with those in the electrorefining half cell 3.

The electrowinning half cell 2 is divided into two by a two-part alumina ceramic partition 12. The molten salt electrolyte in the cathode section of the electrowinning half cell 2 is shown at 13: it is ionically conducting and its function is to enable lithium ions to migrate from the partition 12 to the barrier electrode 4. It will be referred to hereinafter as "heavy salt": a preferred composition is 68 weight percent barium chloride plus 32 weight percent lithium chloride, its density when molten being about 2.40 grams/cc. In the anode section of the electrowinning half cell 2, the molten salt electrolyte has the same composition as the heavy salt, except that in addition it contains lithium carbonate. It is shown at 14. A preferred lithium carbonate concentration for the anolyte 14 is 5 weight percent.

The sole electrolyte in the electrorefining half cell can be seen at 15. It will be referred to hereinafter as the "light salt": a preferred such electrolyte is electrolytically purified lithium chloride, having a density when molten of about 1.46 grams/cc.

An important feature of the cell 1 is two bodies of molten aluminium lithium alloy which can be seen respectively at 16 and 17. In operation of the cell, body 16, which will hereinafter be referred to as the "light metal", has a composition of 15 to 20 weight percent lithium, balance aluminium, and a density of 1.5 to 1.6 grams/cc; and body 17, which will hereinafter be referred to as the "heavy metal", has a composition of about 5 weight percent lithium, balance aluminium, and a density of about 2.11 grams/cc.

The portion 12*a* of the two-piece alumina ceramic partition 12 adjacent to light metal 16 is of fired 99% Coors alumina, whereas the lower portion 12*b* is a porous ceramic diaphragm formed of Coors 100 micron porous alumina, and is designed to permit the passage of lithium ions from the anolyte 14 into the light salt 15, but to prevent the passage of light metal 16 in the reverse direction.

A fired alumina coating 18 on the area of the barrier electrode 4 adjacent to the body 17 of molten heavy metal, and another such fired alumina coating 19 on those areas of cell wall and floor and of the porous diaphragm 12*b* which are adjacent to that body serve to contain it.

It will be seen that the body of light metal 16 and the body of heavy metal 17 serve, in combination with the barrier electrode 4, to prevent the heavy salt 13 catholyte of the electrowinning half cell 2 from contacting the light salt 15 electrolyte of the electrorefining half cell 3.

A steel structure 20 is provided to collect molten electrorefined lithium metal 21 which is produced at the cathode 10. It is provided with an inlet 22 connected to a supply (not shown) of argon gas, and an outlet 23, so that a stream of argon gas can be provided to protect the lithium 21 from atmospheric attack. The structure 20 includes a syphon, a part of which is shown at 24, for the withdrawal of the lithium metal product 21.

It will be seen that the structure 20 is shaped so as to approach closely to the top of the barrier electrode 4 so as to provide a constriction 25 at the top of the barrier electrode 4, and that the fired alumina coating 19 is similarly shaped to approach closely to the bottom of the barrier electrode 4 so as to provide a constriction 26 at the bottom of the barrier electrode: both of the constrictions 25 and 26 serve to control the rate of flow of the aluminium lithium alloy around the barrier electrode 4.

A method of practising the invention using a laboratory-scale electrolytic cell 1 will now be described. The cell 1 used had an overall form approximately that of a cube having sides a little under 20 cm in length, and the titanium diboride barrier electrode was approximately 15 cms in the front to back direction of the cell, 13 cms long and 0.25 cms thick.

The cell, without its salt and light and heavy metal contents was preheated to about 700 degrees C., which was its normal operating temperature, by positioning it within a suitable furnace. With this experimental size of furnace, it was necessary to continue to supply heat from the furnace throughout operation of the cell, to maintain the operating temperature. However, in a commercial size of cell, it would be possible to balance heat losses from the cell by the internal electric resistance losses within the cell during electrolysis.

The various salt and light and heavy metal melt components, at the operating temperature, were then carefully added portionwise so as to attain the situation illustrated in the drawing, care being taken to avoid producing an excessive hydrostatic imbalance across the alumina ceramic partition 12 at any stage of the filling operation.

With the completed cell at operating temperature and the argon supply connected to inlet 22, the d.c. supply 9 and resistor 11 were connected and adjusted to produce a cell current of 30 amps, and circulation of the aluminium-lithium alloy melt was initiated by adding a small amount of heavy metal to the body 17. During normal operation of the cell, the value required for the d.c. supply 9 was about 5.5 volts, the voltage between the anode 8 and the barrier electrode 4 being about 3 volts, and that between the barrier electrode 4 and the cathode 10 being about 2.5 volts. As lithium carbonate was consumed from the anolyte 14, top-up additions were made.

During operation of the cell, the lithium carbonate was consumed as follows: the carbonate anions of the lithium carbonate gave up their charge at the anode of the electrowinning half cell, at the same time reacting with the carbon granules of the packed bed 8*a*, 8*b*:

$$2CO_3^{=}+C=3CO_2+4e.$$

The lithium ions of the lithium carbonate migrated through the porous part 12*b* of the alumina ceramic partition 12 and through the heavy salt 13 to be discharged to lithium metal by contact with upwardly circulating aluminium lithium alloy (shown at 16*a*) which was in contact with the barrier electrode 4, which acted as cathode for the electrowinning half cell 2, the resulting lithium metal alloying with the upwardly flowing aluminium lithium alloy 16*a*. The cathode reaction of the electrowinning half cell was:

$$4Li^{+}+4e=4Li$$

Thus the overall reaction for the electrowinning half cell 2 was:

$$2Li_2CO_3+C=4Li+3CO_2$$

As more metal joined the lithium-rich light metal 16, the light metal at the top of the barrier electrode flowed over the top of the barrier electrode into the electrowinning half cell and then ran down it, as shown at 17*a*. As it did so, the lithium content re-ionised, the barrier electrode 4 then acting as one anode:

$$Li=Li^{+}+e.$$

The lithium ions then migrated through the light salt 15 to the cathode 10 of the electrorefining half cell 3, where they were discharged, forming purified lithium metal, which floated up to be collected as shown at 21.

The cathode reaction in the electrowinning half cell was:

$$Li^{+}+e=Li.$$

It will be appreciated that at the barrier electrode 4 there was a circulation of aluminium-lithium alloy around the electrode, the solute metal Li being such that when its concentration in the alloy increases the density of the alloy decreases, and the effect of electrolytically introducing lithium into the alloy on the left hand side of the barrier electrode 4 and electrolytically removing lithium from the alloy on the right hand side of the barrier electrode 4 providing the motive force required for the circulation of the alloy.

In more detail, light, lithium-rich metal 16 extended downwardly from the top of the barrier electrode 4 on its left-hand side, and its upper surface was hydrostatically connected, by light salt 15, to the upper surface of the heavy, lithium-depleted metal 17 which extended upwardly from the bottom of the barrier electrode 4 on its right-hand side, by the light salt 15, and the heavy salt 13 hydrostatically connected the lower surfaces of the light metal 16 and the heavy metal 17. As more light metal joined the body 15, light metal 15 flowed over the top of the barrier and started to flow down the barrier electrode 4. Because the latter was inclined such that it projected under the overflowing light metal, the latter made good contact with it, as shown at 17*a*. That, plus the fact that the alloy wetted the titanium diboride of the barrier electrode 4 also plus the fact that the alloy flowed in a thin stream, which was further controlled by the restriction 25, all promoted the cathode reaction which caused the electrolytic removal of lithium from the alloy. As it flowed down the barrier electrode 4, alloy's density steadily increased. When it reached the body 17 of heavy, lithium-depleted alloy, a corresponding amount of the latter was caused to flow under the barrier, when it started to float up through the heavy salt 13 towards the light metal 16 as shown at 16*a*. Again, the fact that the barrier electrode 4 was inclined such that it then overhung the rising alloy caused the alloy to make good contact with the barrier electrode. The additional factors which promoted the anode reaction for the removal of lithium from the descending alloy in the electrorefining half cell 3, equally promoted the cathode reaction for the introduction of lithium into the ascending alloy in the electrowinning half cell 2.

Operation of the above cell in accordance with the invention achieved a rate of production of purified lithium metal 21 of 8 grams per hour, with a corresponding consumption of lithium carbonate of 46 grams per hour and of carbon granules of about 4 grams per hour. The overall efficiency of the cell was 92%. The overall cell voltage was 6.5 volts and the current density was 500 amps per square foot.

From the foregoing, it will be appreciated that it is possible, in accordance with the invention, to carry out the electrolytic production of a metal in an electrolytic cell comprising an electrowinning half cell and an electrorefining half cell in such a way as to achieve the following advantages over the operation of the Slatin cell:

(a) use of a cell of generally vertical electrode configuration, giving a small floor area;

(b) low electrolyte resistance losses, through small electrode spacings; and (c) uniform current paths, with consequent high energy efficiency in operation.

I claim:

1. A method of transporting a liquid A past a barrier, the method comprising: providing liquid A on both a first and a second side of the barrier, the liquid A on the first side being in hydrostatic communication with that on the second side both over and under the barrier, and liquid A on at least the second side of the barrier containing a solute S, solute S being a metal and solute S being such that increasing the concentration of solute S in liquid A either (a) increases or (b) decreases the density of the solution; and introducing solute S into liquid A on the first side of the barrier and removing solute S from liquid A on the second side of the barrier, whereby to cause passage of liquid A around the barrier, with S-rich liquid A from the first side passing under the barrier and S-depleted liquid A from the second side passing over the barrier in case (a), and S-rich liquid A from the first side passing over the barrier and S-depleted liquid A from the second side passing under the barrier in case (b).

2. A method according to claim 1, wherein liquid A is a metal.

3. A method according to claim 1, wherein solute S is introduced into liquid A on the first side of the barrier electrolytically.

4. A method according to claim 1, wherein solute S is removed from liquid A on the second side of the barrier electrolytically.

5. A method according to claim 1, wherein a liquid of relatively low density LD hydrostatically connects the upper surface of a body of liquid A which extends downwardly from the top of the barrier on one side of the barrier with the upper surface of a body of liquid A which extends upwardly from the bottom of the barrier on the other side of the barrier, and a liquid of relatively high density HD hydrostatically connects the respective lower surfaces of those two bodies of liquid A.

6. A method according to claim 1, wherein there is a constriction at the top and/or at the bottom of the barrier, to control the rate of transport of liquid A.

7. A method according to claim 1, when performed in the course of the electrolytic production of a metal M in an electrolytic cell which comprises an electrowinning half cell and an electrorefining half cell, the barrier separating the two half cells, and during operation of the cell the liquid A dissolving metal, acting as solute S, produced in the electrowinning half cell, and being transported past the barrier to the electrorefining half cell, where dissolved metal is removed from the liquid A and electrorefined.

8. A method according to claim 7, wherein the barrier is electronically conductive and acts as a common electrode for the electrowinning and electrorefining half cells.

9. A method according to claim 8, wherein the liquid A is electronically conductive and is electrically in contact with the common electrode barrier.

10. A method according to claim 9, wherein the liquid A wets the common electrode barrier.

11. A method according to claim 9, wherein the common electrode barrier is inclined such that it overhangs liquid A passing under it and projects under liquid A passing over it.

12. A method according to claim 7, wherein the liquid A is electronically conductive and is electrically in contact with the common electrode for the electrowinning and electrorefining half cells.

13. A method according to claim 7, wherein the metal produced in the electrolytic cell is lithium.

14. A method according to claim 13, wherein liquid A comprises aluminium.

15. A method according to claim 14, wherein the barrier comprises a refractory hardmetal, preferably titanium diboride.

16. A method according to claim 13, wherein the electrolyte in the electrowinning half cell comprises lithium carbonate, and the anode reaction in the electrowinning half cell is $$2CO_3^{=}+C=3CO_2+4e.$$

17. A method according to claim 7, wherein the metal produced in the electrolytic cell is magnesium.

18. A method according to claim 17, wherein liquid A comprises aluminium.

19. A method of transporting a liquid A past a barrier, the method comprising: providing liquid A on both a first and a second side of the barrier, the liquid A on the first side being in hydrostatic communication with that on the second side both over and under the barrier, and liquid A on at least the second side of the barrier containing a solute S, solute S being such that increasing the concentration of solute S in liquid A either (a) increases or (b) decreases the density of the solution; and introducing solute S into liquid A on the first side of the barrier and removing solute S from liquid A on the second side of the barrier, whereby to cause passage of liquid A around the barrier, with S-rich liquid A from the first side passing under the barrier and S-depleted liquid A from the second side passing over the barrier in case (a), and S-rich liquid A from the first side passing over the barrier and S-depleted liquid A from the second side passing under the barrier in case (b), wherein a liquid of relatively low density LD hydrostatically connects the upper surface of a body of liquid A which extends downwardly from the top of the barrier on one side of the barrier with the upper surface of a body of liquid A which extends upwardly from the bottom of the barrier on the other side of the barrier, and a liquid of relatively high density HD hydrostatically connects the respective lower surfaces of those two bodies of liquid A.

20. A method according to claim 19, wherein the barrier is inclined such that it overhangs liquid A passing under it and projects under liquid A passing over it.

* * * * *